US009822975B2

(12) United States Patent
Cadeau et al.

(10) Patent No.: US 9,822,975 B2
(45) Date of Patent: Nov. 21, 2017

(54) GAS VALVE UNIT HAVING TWO GAS OUTLETS

(75) Inventors: Christophe Cadeau, Strasbourg (FR); Jörn Naumann, Durbach (DE)

(73) Assignee: BSH Hausgeräte GmbH, Munich (DE)

( * ) Notice: Subject to any disclaimer, the term of this patent is extended or adjusted under 35 U.S.C. 154(b) by 1172 days.

(21) Appl. No.: 13/696,817

(22) PCT Filed: May 10, 2011

(86) PCT No.: PCT/EP2011/057481
§ 371 (c)(1),
(2), (4) Date: Nov. 8, 2012

(87) PCT Pub. No.: WO2011/144492
PCT Pub. Date: Nov. 24, 2011

(65) Prior Publication Data

US 2013/0059256 A1 Mar. 7, 2013

(30) Foreign Application Priority Data

May 20, 2010 (EP) ..... 10290271

(51) Int. Cl.
*F23N 1/00* (2006.01)

(52) U.S. Cl.
CPC ..... *F23N 1/00* (2013.01); *F23D 2900/14062* (2013.01); *F23N 2035/18* (2013.01); *F23N 2035/24* (2013.01); *F23N 2037/02* (2013.01); *F23N 2041/08* (2013.01); *Y10T 137/87708* (2015.04)

(58) Field of Classification Search
CPC .... F23N 1/00; F23N 2041/08; F23N 2035/18; F23N 2035/24; F23N 2037/02; F23D 2900/14062
USPC ..... 137/625.42, 862; 431/280; 251/65
See application file for complete search history.

(56) References Cited

U.S. PATENT DOCUMENTS 847,210 A * 3/1907 Springer ..... F23D 14/06 431/278
1,664,508 A * 4/1928 Philip ..... F23D 14/085 137/625
2,549,952 A * 4/1951 Wheelock ..... F23D 14/045 236/1 E (Continued)

FOREIGN PATENT DOCUMENTS

WO 2008141916 A2 11/2008
WO 2009010400 A1 1/2009

OTHER PUBLICATIONS

International Search Report PCT/EP2011/057481 dated Feb. 18, 2013.

*Primary Examiner* — Michael R Reid
*Assistant Examiner* — Christopher Ballman
(74) *Attorney, Agent, or Firm* — Michael E. Tschupp; Andre Pallapies; Brandon G. Braun

(57) ABSTRACT

A gas valve unit for setting a gas volumetric flow to a twin-circuit gas burner of a gas appliance includes a valve body having a gas inlet and two gas outlets, and a control mechanism for adjusting the gas volumetric flow to at least one of the gas outlets in a multiple-stage manner. The control mechanism has a zero position in which the gas volumetric flow to the gas outlets is interrupted, and a switching position which is adjacent to the zero position and in which the gas volumetric flow is set to a maximum value.

44 Claims, 7 Drawing Sheets

(56) References Cited

U.S. PATENT DOCUMENTS 2,601,321 A 6/1952 Ray
3,933,419 A * 1/1976 Romanelli ..... F23Q 7/10 431/66
4,402,663 A * 9/1983 Romanelli ..... F23N 5/022 361/264
5,842,849 A * 12/1998 Huang ..... F23D 14/06 126/39 R
5,938,425 A * 8/1999 Damrath ..... F23N 1/005 126/39 E
6,082,388 A * 7/2000 Turrin ..... F23N 5/107 126/503
6,609,904 B2 * 8/2003 Chen ..... F23N 1/005 126/116 A
7,291,009 B2 * 11/2007 Kamal ..... F23D 14/06 126/39 E
2002/0172903 A1 11/2002 Chen
2003/0031965 A1 * 2/2003 Tomolillo ..... F23N 1/022 431/4
2004/0055651 A1 * 3/2004 Baarda ..... F23N 1/005 137/613
2004/0129321 A1 * 7/2004 Erbe ..... F16K 1/44 137/625.33
2006/0016444 A1 * 1/2006 Clauss ..... F23N 1/005 126/39 E
2006/0057520 A1 * 3/2006 Saia ..... F23N 1/005 431/281
2006/0137749 A1 * 6/2006 Bonne ..... F16K 31/02 137/613
2006/0231085 A1 * 10/2006 Gnadinger ..... F24C 3/126 126/39 N
2006/0260603 A1 * 11/2006 Shah ..... A47J 37/0713 126/41 R
2007/0204858 A1 * 9/2007 Abelbeck ..... F24C 3/12 126/41 R
2007/0277813 A1 * 12/2007 Deng ..... F23C 1/08 126/92 R
2008/0210783 A1 * 9/2008 Bissonnette ..... F23D 14/32 239/429
2008/0241772 A1 * 10/2008 Zanella ..... F23N 1/005 431/75
2008/0268388 A1 * 10/2008 Zanella ..... F23K 5/007 431/38
2010/0018585 A1 * 1/2010 Pavin ..... F23N 1/005 137/66
2013/0186492 A1 * 7/2013 Deng ..... F23N 1/007 137/624.27

* cited by examiner

GAS VALVE UNIT HAVING TWO GAS OUTLETS

BACKGROUND OF THE INVENTION

The invention relates to a gas valve unit for setting gas volumetric flows to a twin-circuit gas burner of a gas appliance, in particular a gas cooking appliance, wherein the gas valve unit has a gas inlet and two gas outlets.

In gas cooking appliances gas burners are frequently used, which have two concentrically disposed rings with gas outlet openings. During operation of the gas cooktop a ring of flame can burn at each of the rings with gas outlet openings. If the gas volumetric flows to both rings with gas outlet openings can be set separately from one another, said gas burners are referred to as twin-circuit gas burners. Twin-circuit gas burners generally have a greater maximum thermal output than conventional gas burners with just one ring of flame. Twin-circuit gas burners also have a particularly good spread between minimum thermal output and maximum thermal output. At maximum thermal output both rings of flame burn with the largest flames possible. At minimum thermal output only the smaller ring of flame burns with the smallest flames possible, while no gas flows out of the larger ring with flame outlet openings.

Gas valves for supplying twin-circuit gas valves have a gas inlet, with which the gas valve is connected to a main gas line of the gas cooking appliance. A first gas outlet of the gas valve opens into a first gas sub-line leading to the smaller ring with gas outlet openings. A second gas outlet is connected to a gas sub-line leading to the larger ring with gas outlet openings.

Twin-circuit gas valves have a single actuation element, which can be used to set both the gas flow to supply the first ring of flame and the gas flow to supply the second ring of flame. According to a standard model the completely closed position of the twin-circuit gas valve is followed immediately by the switching position for maximum output of both rings of flame. Further actuation of the operating element initially reduces the output of the larger ring of flame, until it is extinguished completely. The output of the smaller ring of flame is then reduced, until it reaches its minimum output. With this embodiment either the twin-circuit gas valve is completely closed or only the gas flow to the smaller ring with gas outlet openings is opened or the gas flow to both rings with gas outlet openings is opened, depending on the position of the actuation element. However provision is not made for closing the gas flow to the smaller ring with gas outlet openings, while the gas flow to the larger ring with gas outlet openings is open.

Known gas valve units for twin-circuit gas burners are generally embodied as plug valves, in which a valve plug is rotated in a valve housing by means of the actuation element. It has proven difficult to set a desired thermal output precisely and reproduce such a setting with such known valves.

BRIEF SUMMARY OF THE INVENTION

The object of the present invention is to supply a generic gas valve unit, which can be set more easily.

According to the invention this object is achieved in that the gas volumetric flow to at least one of the gas outlets can be set in a multiple-stage manner, in a zero position of the gas valve unit the gas volumetric flow to both gas outlets is interrupted and in a switching position adjacent to the zero position the gas volumetric flow, which can be set in a multiple-stage manner, is set to a maximum value. The gas volumetric flow can thus be set precisely and in a reproducible manner in multiple stages. The switching stage at which the gas volumetric flow is at a maximum is immediately adjacent to the zero position of the gas valve unit here. When the gas valve unit is opened, the gas volumetric flow is therefore set immediately to a maximum value. This ensures that the gas-conducting components behind the gas valve unit fill with gas quickly. Also ignition of the gas burner is particularly reliable at maximum gas volumetric flow. The gas valve unit is therefore in an optimum position for ignition of the gas burner immediately after opening.

It is further advantageous, if in a switching position adjacent to the zero position the gas volumetric flow, which can be set in a multiple-stage manner, is set to a maximum value and the gas volumetric flow to the other gas outlet is also opened. Once the gas valve unit has been opened, the gas flow to both gas outlets is therefore immediately opened.

It is particularly advantageous for the gas volumetric flows to both gas outlets to be able to be set in a multiple-stage manner, with both gas volumetric flows being set to a maximum value in a switching position adjacent to the zero position. This means that all the gas-conducting components behind the gas valve unit are filled with gas particularly quickly. Ignition of the gas burner takes place in the switching position adjacent to the zero position with maximum gas output from all gas outlet openings.

To set the gas volumetric flow supplied to a first gas outlet the gas valve unit has at least two open/close valves and at least two first throttle points, preferably at least three first open/close valves and at least three first throttle points. The number of open/close valves and the number of throttle points determine the number of available switching stages. The more switching stages there are available, the more precisely the thermal output of the gas burner assigned to the gas valve can be set.

Similar advantages emerge when the gas valve unit has at least two second open/close valves and at least two second throttle points, preferably at least four second open/close valves and at least four second throttle points for setting the gas volumetric flow supplied to a second gas outlet.

To control the open/close valves at least one magnetically active body is provided, which can be moved relative to the open/close valve. A magnetically active body can be for example a permanent magnet, which is able to attract a ferromagnetic valve body of the open/close valve. Likewise the magnetically active body can be a ferromagnetic body that is not permanently magnetized, if a valve body of the open/close valve is formed by a permanent magnet or connected to a permanent magnet. The open/close valves are opened or closed by moving the magnetically active body relative to the open/close valves. A magnetic force only acts between the magnetically active body and the open/close valve to open the open/close valve, when the magnetically active body is in direct proximity to the open/close valve.

In one advantageous embodiment of the invention at least two magnetically active bodies are provided to control the open/close valves, with a first magnetically active body being formed by a ferromagnetic body and the second magnetically active body being formed by a permanent magnet.

The first magnetically active body and the second magnetically active body here are coupled to one another in such a manner that they can be moved synchronously with the open/close valves. The coupling is preferably embodied in such a manner that the two magnetically active bodies are necessarily always moved synchronously with one another.

At least one first open/close valve has a permanent magnet, such that said first open/close valve can be controlled as a function of the position of the first magnetically active body, which is formed by a ferromagnetic body. The other open/close valves, which do not have permanent magnets, can in contrast not be controlled by the first magnetically active body, which has a ferromagnetic body.

It is further advantageous, if the first magnetically active body, which is formed by a ferromagnetic body, is embodied such that it brings about an opening of the open/close valve, which has a permanent magnet, in at least three switching positions of the gas valve unit. The open/close valve, which has a permanent magnet, is therefore opened in a number of switching positions of the gas valve unit, unlike the other open/close valves.

Immediate complete opening of the gas valve unit is achieved in that in a switching position adjacent to the zero position the first magnetically active body, which is formed by a ferromagnetic body, opens the first open/close valve, which has a permanent magnet, and the second magnetically active body, which is formed by a permanent magnet, opens a second open/close valve.

In every switching position, in which the second magnetically active body, which is formed by a permanent magnet, opens at least one second open/close valve, the first magnetically active body, which is formed by a ferromagnetic body, opens the first open/close valve, which has a permanent magnet. This ensures that in the case of a twin-circuit gas burner the outer ring of flame does not burn alone at any time, while the inner ring of flame is not supplied with gas. Instead the inner ring of flame always burns with the outer ring of flame.

In at least one switching position, in which the second magnetically active body, which is formed by a permanent magnet, opens at least one first open/close valve, the first magnetic body does not open any of the open/close valves. None of the second open/close valves is open in such a switching position either. The first magnetically active body has no function in these switching positions.

Depending on the position of the second magnetically active body, which is formed by a permanent magnet, said second magnetically active body either does not open any open/close valve or opens just one open/close valve or opens just two open/close valves. The second magnetically active body does not open any open/close valve when the gas valve unit is in the zero position. The second magnetically active body opens just one open/close valve when it is located directly above the open/close valve. The second magnetically active body opens just two open/close valves in intermediate positions between two open/close valves. It is however ensured that when switching between two switching positions of the gas valve unit, all the open/close valves are never closed at the same time, thereby extinguishing the flames at the gas burner.

In one preferred embodiment the gas valve unit comprises a first throttle section, in which the first throttle points are disposed in a row, having a connecting segment between each set of two adjacent first throttle points, which a first open/close valve in the opened state connects to the gas inlet.

Similarly the gas valve unit comprises a second throttle section, in which the second throttle points are disposed in a row, having a connecting segment between each set of two adjacent throttle points, which a second open/close valve in the opened state connects respectively to the gas inlet.

The throttle points of the first throttle section—when viewed in the gas flow direction in the first throttle section—have an increasing flow cross section. The gas volumetric flow to the gas outlet is therefore only significantly determined by the first throttle point present in the gas flow. The subsequent throttle points in the gas flow direction have a larger flow cross section and hardly influence the volumetric flow at all.

Similarly the throttle points of the second throttle section—when viewed in the gas flow direction of the second throttle section—also have an increasing flow cross section.

BRIEF DESCRIPTION OF THE DRAWINGS

Further advantages and details of the invention are described in more detail with reference to the exemplary embodiment illustrated in the schematic figures, in which.

DETAILED DESCRIPTION OF EXEMPLARY EMBODIMENTS OF THE PRESENT INVENTION

Figure 1:
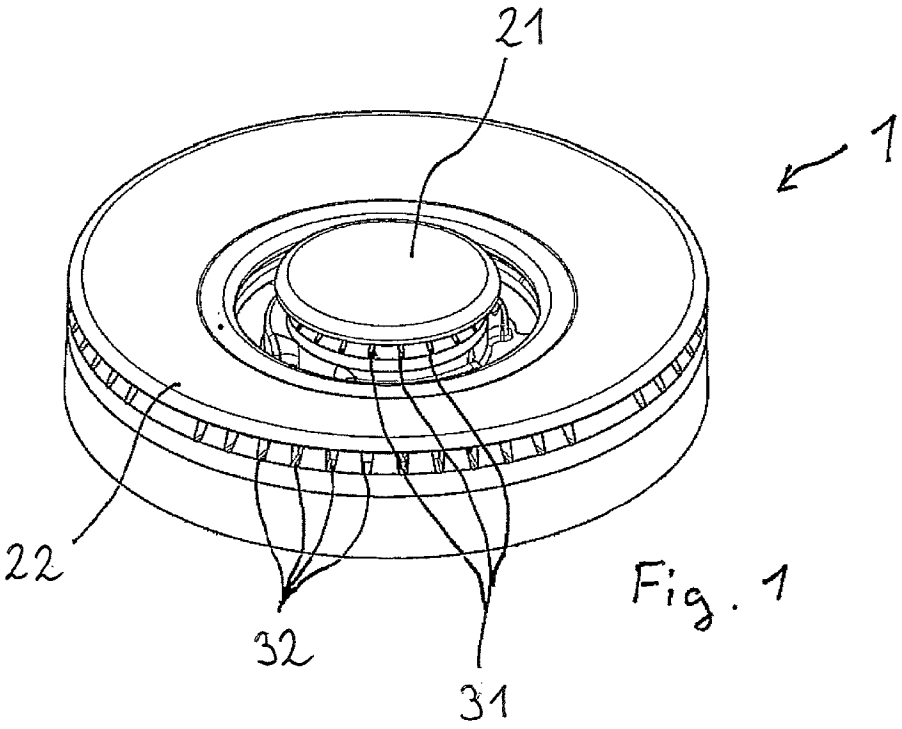
FIG. 1 shows a twin-circuit gas burner.

FIG. 1 shows a twin-circuit gas burner 1, as used generally in gas cooktops. The twin-circuit gas burner 1 comprises an inner burner 21 with first gas outlet openings 31 and an outer burner 22 with second gas outlet openings 32. The gas volumetric flows exiting through the first gas outlet openings 31 and the second gas outlet openings 32 and therefore the flame sizes of a first ring of flame at the inner burner 21 and a second ring of flame at the outer burner 22 can be set separately from one another. Flames are only present at the inner burner 21 for a minimum output of the twin-circuit gas burner 1. Flames are present at both the inner burner 21 and the outer burner 22 for maximum output of the twin-circuit gas burner 1. Between the maximum output and the minimum output the output of the twin-circuit gas burner 1 can be reduced in stages starting from the maximum output by first reducing the flame size at the outer burner 22 until there is no longer any flame burning at the outer burner 22 and then reducing the flame size at the inner burner 21 in stages.

Figure 2:
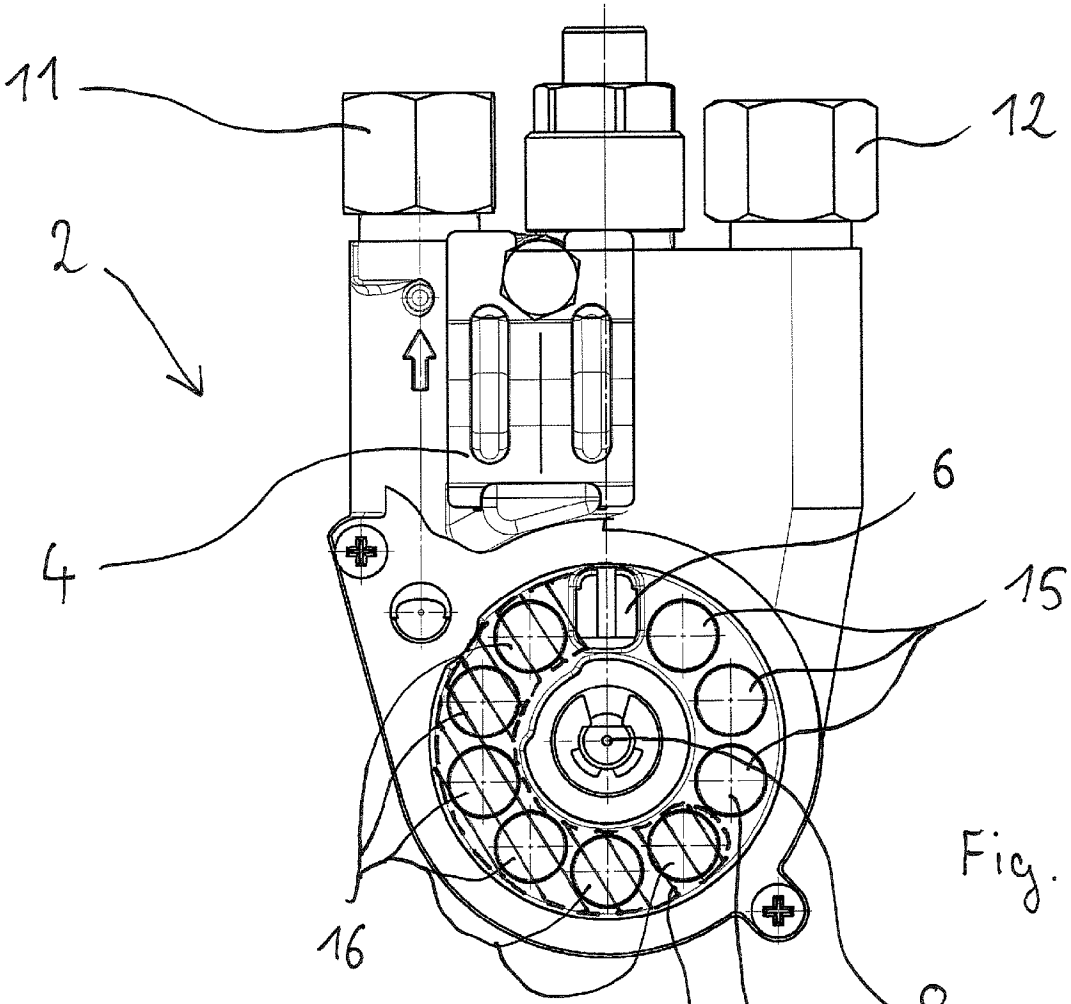
FIG. 2 shows an inventive gas valve unit in the form of a twin-circuit gas valve.

FIG. 2 shows an inventive gas valve unit embodied as a twin-circuit gas valve 2 for supplying such a twin-circuit gas burner 1. The twin-circuit gas valve 2 has a single gas inlet 3, which in the figure is located behind a clamping plate 4 for fastening the twin-circuit gas valve 2 to a gas line, a first gas outlet 11 and a second gas outlet 12. The first gas outlet 11 is provided for connection to the inner burner 21 of the twin-circuit gas burner 1, while the second gas outlet 12 is provided for connection to the outer burner 22 of the twin-circuit gas burner 1. The gas flow to the first gas outlet 11 is controlled by the first open/close valves 15, the gas flow to the second gas outlet 12 by second open/close valves 16. Two magnetically active bodies 5, 6 are provided to control the open/close valves 15, 16.

The second magnetically active body 6 is formed by a permanent magnet, which can be moved from the illustrated zero position counterclockwise about an axis 8. The first magnetically active body 5 is connected to the second magnetically active body 6 in such a manner that it is moved about the axis 8 together with the second magnetically active body 6. The first magnetically active body 5 is made of a ferromagnetic material and is therefore not a permanent magnet. The characterizing property of a ferromagnetic material is that it is not magnetic itself but it is attracted by a magnet. In the present exemplary embodiment the first magnetically active body 5 is formed by a C-shaped steel sheet and is shown transparently hatched in FIG. 2.

All the second open/close valves 16 and all the first open/close valves 15, with the exception of the first open/close valve 15.3, have non-magnetic ferromagnetic valve bodies. The open/close valve 15.3 has a valve body in the form of or connected to a permanent magnet 13. The second magnetically active body 6 formed by a permanent magnet can exert an attraction force on the valve bodies of all the first open/close valves 15, including the open/close valve 15.3, the permanent magnet 13 of which is correspondingly polarized, and of all the open/close valves 16, when it is positioned above the corresponding valve body.

The first magnetically active body 5 can only exert an attraction force on the valve body of the open/close valve 15.3, which is embodied as a permanent magnet 13 or is coupled to such. This always happens when a part of the first magnetically active body 5 is located above said open/close valve 15.3.

The basic structure of the inventive gas valve, in particular the manner of interaction of the second magnetically active body 6 with the associated open/close valves 15 and 16 and the conducting of gas in the interior of the gas valve, corresponds to the structure of the subject matter of the European patent applications 09290589.2, 09290590.0 and 09290591.8 submitted on Jul. 27, 2009.

In the position illustrated in FIG. 2 the second magnetically active body 6 is located next to the open/close valves 15, 16, so that it does not open any of the open/close valves 15, 16. The first magnetically active body 5 is located next to the first open/close valve 15.3 so that this valve 15.3 is not opened either. The twin-circuit gas valve 2 is therefore completely closed. When the twin-circuit gas valve 2 is actuated, the magnetically active bodies 5, 6 are moved counterclockwise about the axis 8. The movement of the magnetically active bodies 5, 6 always takes place synchronously here.

The circuit in the interior of the twin-circuit gas valve 2 is described below with reference to the schematic FIGS. 3 to 11 in different switching positions. These each show the first magnetically active body 5, the second magnetically active body 6, the first open/close valves 15 (15.1, 15.2, 15.3), the second open/close valves 16 (16.1 to 16.6), first throttle points 17 (17.1, 17.2, 17.3) and second throttle points 18 (18.1 to 18.6). If at least one first open/close valve 15 is opened, a first branch of the gas flow leads from the gas inlet 3 by way of this opened first open/close valve 15 and through at least one of the throttle points 17 to the first gas outlet 11. If at least one second open/close valve 16 is opened, a second branch of the gas flow leads from the gas inlet 3 by way of this opened second open/close valve 16 and through at least one of the second throttle points 18 to the second gas outlet 12. The first throttle points 17.1, 17.2 and 17.3 have three cross sections that increase in order, when viewed from right to left in the gas flow direction through the throttle points 17. The gas volumetric flow flowing to the first gas outlet 11 is significantly defined only by the first throttle point 17 in the gas flow. If for example the open/close valve 15.1 is opened, the throttle point 17.1 in particular determines the size of the gas volumetric flow. If the first open/close valve 15.2 is opened, the throttle point 17.2 determines the gas volumetric flow and when the open/close valve 15.3 is opened, the gas volumetric flow is determined by the throttle point 17.3. The last of the throttle points 17.3 can have such a large flow cross section that the gas volumetric flow is practically no longer throttled. The circuit and mode of operation of the second open/close valves 16 in conjunction with the second throttle points 18 in the branch of the gas volumetric flow leading to the second gas outlet 12 is similar.

Figure 3:
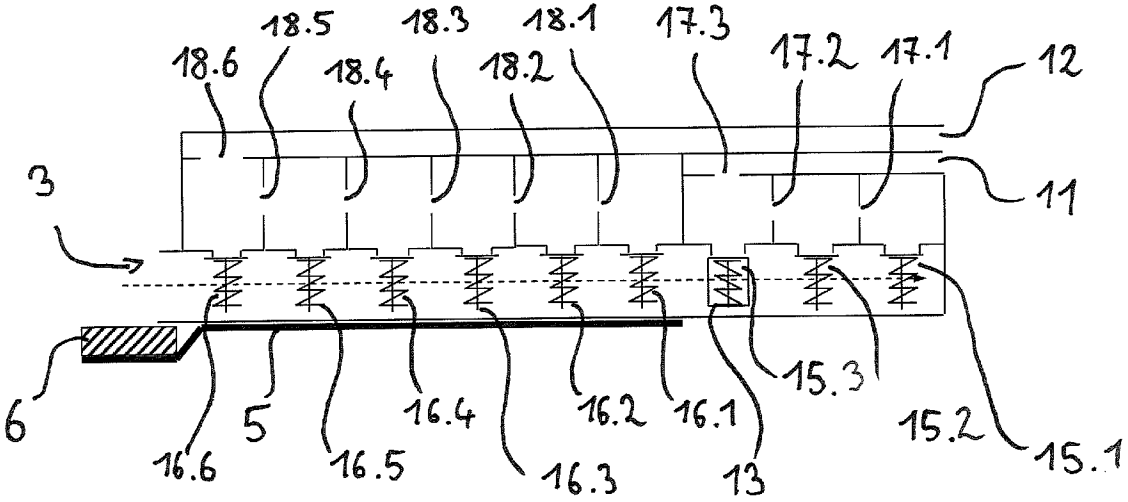
FIG. 3 shows the switching position of the closed twin-circuit gas valve.

FIG. 3 shows the switching position of the closed twin-circuit gas valve 1. In this switching position the first magnetically active body 5 is to the left of the first open/close valve 15.3 in the drawing and the second magnetically active body 6 is to the left of the second open/close valves 16 in the drawing. This position of the magnetically active bodies 5, 6 corresponds to the switching position illustrated in FIG. 2. All the open/close valves 15, 16 are closed by spring force here. The gas present at the gas inlet 3 can flow neither to the first gas outlet 11 nor to the second gas outlet 12.

If the two coupled magnetically active bodies 5, 6 are moved to the right in the drawing from the position according to FIG. 3, the first magnetically active body 5, which is made of ferromagnetic material, opens the first open/close valve 15.3, which is equipped with a permanent magnet 13, and the second magnetically active body 6, which is embodied as a permanent magnet, opens the second open/close valve 16.6.

Figure 4:
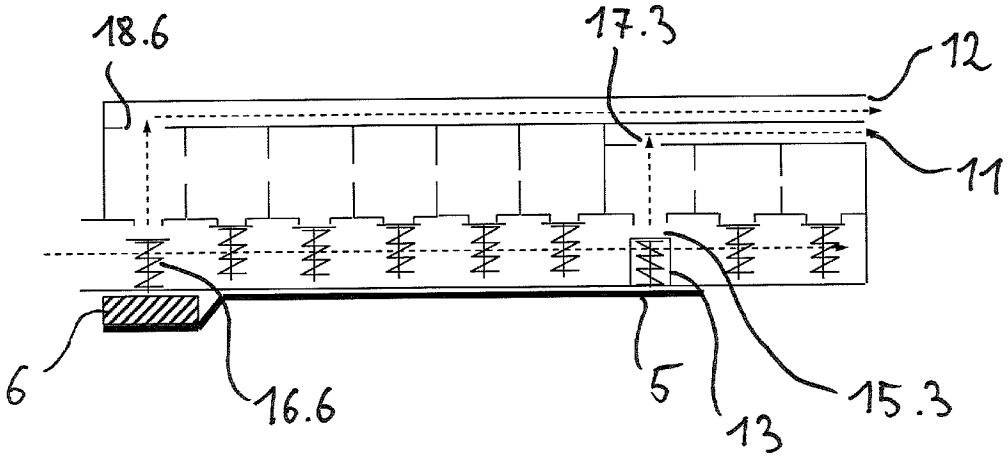
FIG. 4 shows the switching position of the twin-circuit gas valve in a first switching position.

This switching position is illustrated in FIG. 4. The opened first open/close valve 15.3 here allows a maximum gas volumetric flow by way of the first throttle point 17.3 to the first gas outlet 11. The opened second open/close valve 16.6 allows a maximum gas volumetric flow by way of the second throttle point 18.6 to the second gas outlet 12.

If the magnetically active bodies 5, 6 move further to the right in the drawing, the second magnetically active body 6 then also opens the second open/close valve 16.5. The movement of the first magnetically active body 5 to the right however does not cause the opening of a further first open/close valve 15.2 or 15.3, as these do not have permanent magnets.

Figure 5:
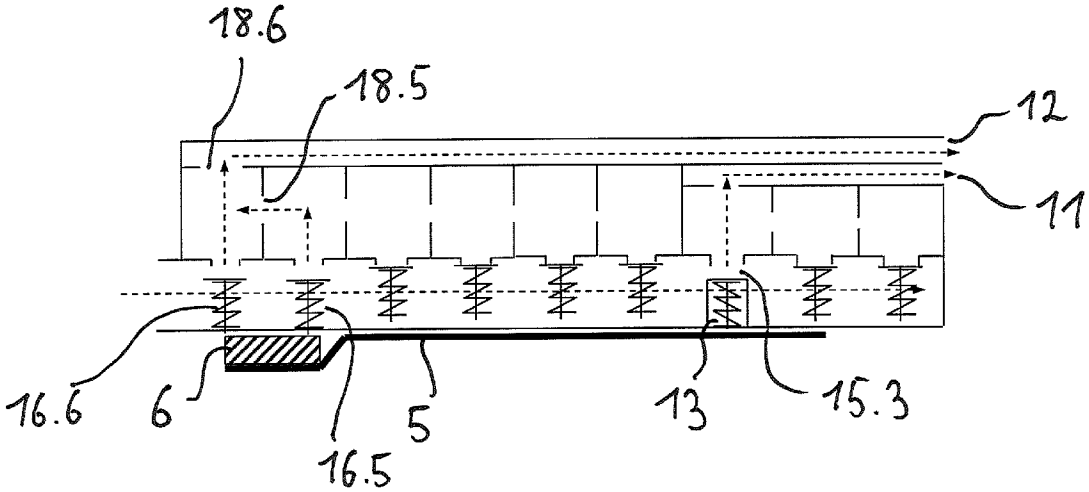
FIG. 5 shows the switching position of the twin-circuit gas valve between a first and a second switching position.

This switching position is illustrated in FIG. 5. The biggest part of the gas flow reaching the second gas outlet 12 here flows through the opened open/close valve 16.6 and the throttle point 18.6. The gas flow arriving through the opened open/close valve 16.5 and the throttle point 18.5 is negligibly small by comparison. The gas volumetric flow reaching the second gas outlet 12 in this switching position is practically identical to the gas volumetric flow in the switching position according to FIG. 4.

If the magnetically active bodies 5, 6 are moved further to the right in the drawing, the open/close valve 16.6 closes and only the open/close valve 16.5 remains open.

Figure 6:
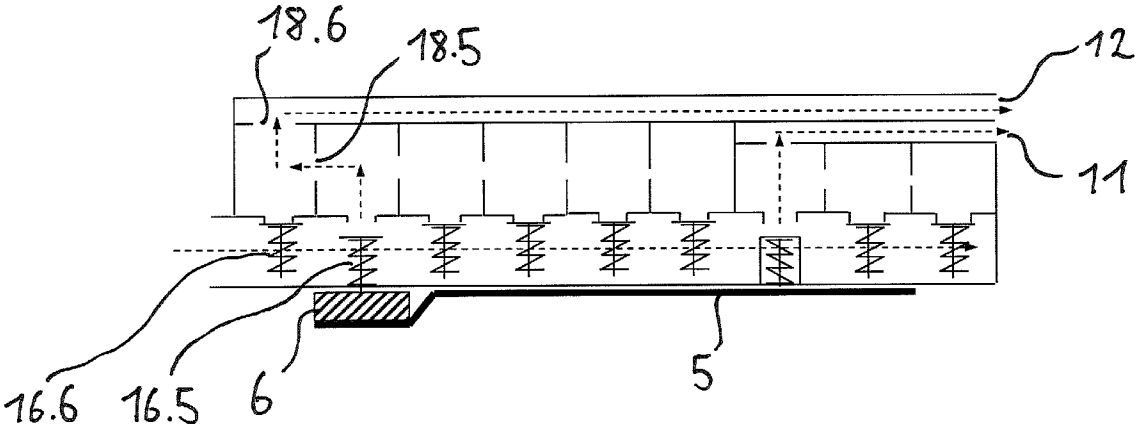
FIG. 6 shows the switching position of the twin-circuit gas valve in a second switching position.

This switching position is illustrated in FIG. 6. It is particularly important for the function of the twin-circuit gas valve that during switching from the opened open/close valve 16.6 to the opened open/close valve 16.5 both open/close valves 16.6 and 16.5 are temporarily open, as this ensures a continuous gas flow and prevents undesirable interruption of the gas flow and therefore the extinguishing of the gas flames during the switching process.

Figure 7:
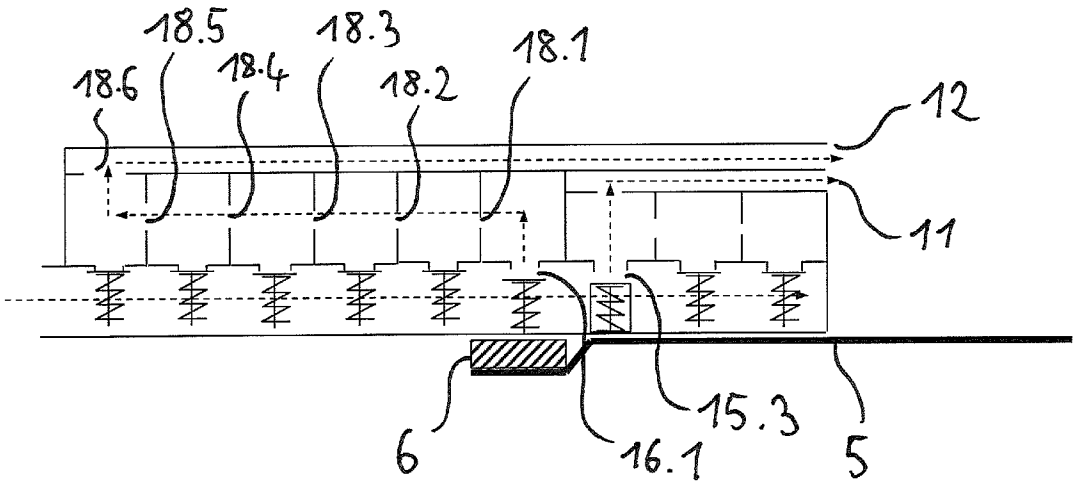
FIG. 7 shows the switching position of the twin-circuit gas valve in a sixth switching position.

In the switching position illustrated in FIG. 7 the open/close valves 15.3 and 16.1 are open. The gas volumetric flow to the first gas outlet 11 is at maximum size. In contrast the gas volumetric flow to the second gas outlet 12 is at a minimum, as it flows through all the second throttle points 18.1 to 18.6 and is therefore throttled to a maximum, in particular by the throttle point 18.1 with the smallest flow cross section.

Figure 8:
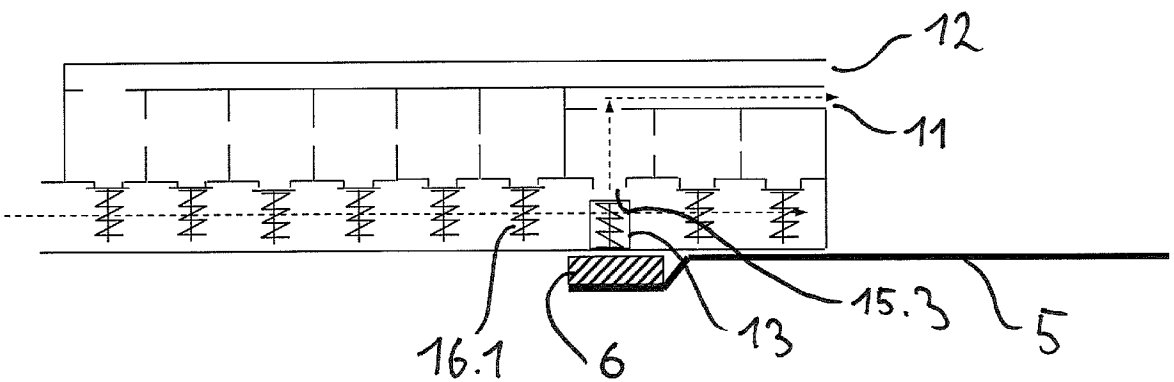
FIG. 8 shows the switching position of the twin-circuit gas valve in a seventh switching position.

FIG. 8 shows the next switching position of the gas valve unit, in which the second magnetically active body 6 is located in the region of the first open/close valve 15.3. In this switching position the second magnetically active body 6 does not exert a magnetic force on any of the second open/close valves 16 so they are closed. However the second magnetically active body 6 now opens the first open/close valve 15.3 in that the second magnetically active body 6, which is formed by a permanent magnet, attracts the permanent magnet 13. The permanent magnet 13 here is polarized in such a manner that it is attracted and not repelled by the second magnetically active body 6. In this switching position the gas flow to the first gas outlet 11 is set to a maximum value due to the opened first open/close valve 15.3, while the gas flow to the second gas outlet 12 is closed.

If the two magnetically active bodies 5, 6 are now moved further to the right, the first open/close valves 15 close and open one after the other. This is solely due to the magnetic force of the second magnetically active body 6. In these switching positions the first magnetically active body 5 then has no switching function.

Figure 9:
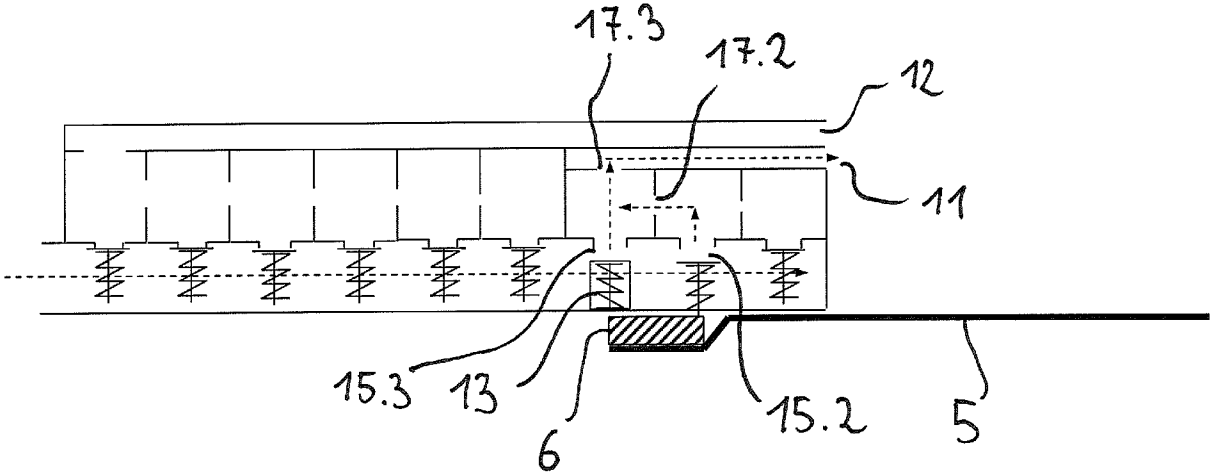
FIG. 9 shows the switching position of the twin-circuit gas valve between a seventh and an eighth switching position.

The first open/close valve 15.2 also initially opens here according to FIG. 9, while the first open/close valve 15.3 remains open. The gas volumetric flow to the first gas outlet 11 here is practically identical to the gas volumetric flow in the switching position according to FIG. 8.

Figure 10:
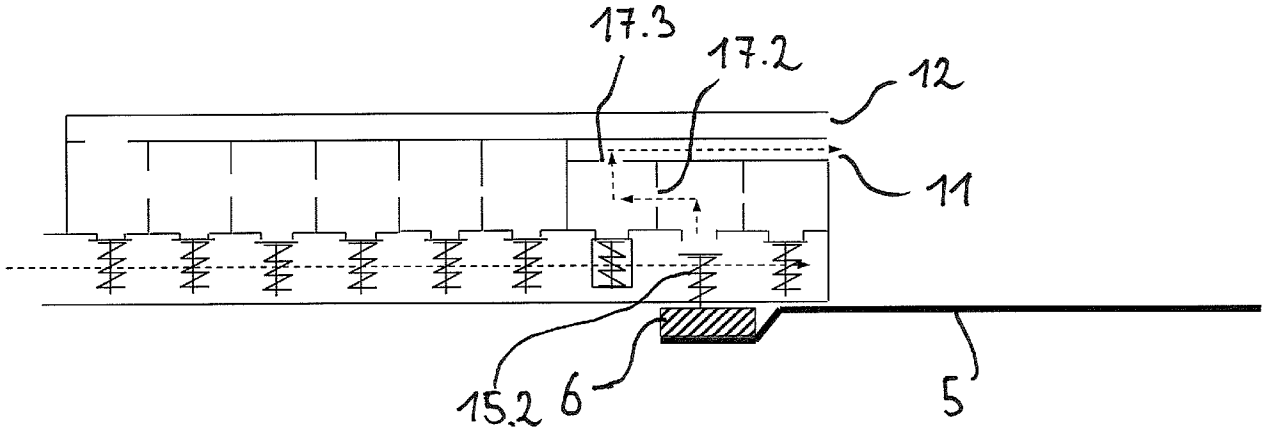
FIG. 10 shows the switching position of the twin-circuit gas valve in an eighth switching position.

In contrast in the switching position according to FIG. 10 the gas volumetric flow to the first gas outlet 11 is reduced once the first open/close valve 15.3 is closed and only the first open/close valve 15.2 is opened by the second magnetically active body 6.

Figure 11:
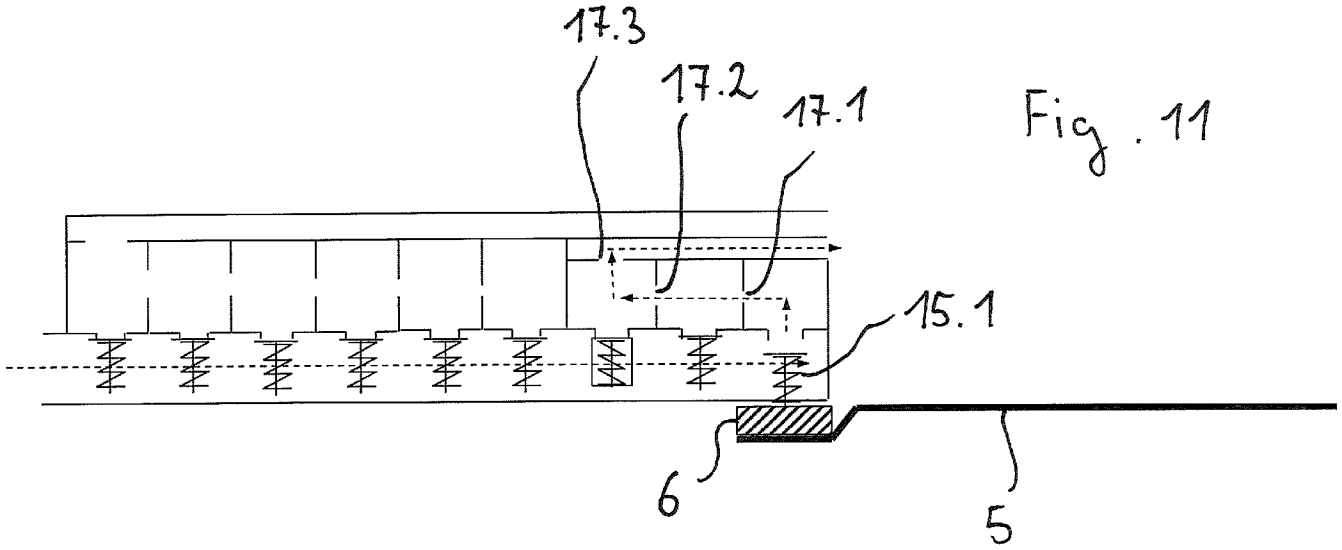
FIG. 11 shows the switching position of the twin-circuit gas valve in a ninth switching position.

FIG. 11 finally shows the minimum position of the gas valve unit, in which the second magnetically active body 6 opens the first open/close valve 15.1 and all the other open/close valves 16, 15.2 and 15.3 are closed. The gas flow to the first gas outlet 11 here flows through all the first throttle points 17 and is therefore throttled to the maximum.

On actuation of the twin-circuit gas valve 2 in the opposite direction both magnetically active bodies 5, 6 are moved back. The movement of the two magnetically active bodies 5, 6 is always synchronous here too. In the process the gas flow to the first gas outlet 11 is first enlarged and then the gas flow to the second gas outlet 12. Once the gas flow to both gas outlets 11, 12 has reached its maximum value, the twin-circuit gas valve is completely closed in the following switching position.

Actuation of the twin-circuit gas valve 2 is effected using a suitable movement apparatus. This can comprise a manually actuatable rotary toggle for example. Rotation of the rotary toggle then displaces the magnetically active body 5, 6 relative to the open/close valves 15, 16 in the manner described above.

Alternatively it is also possible to equip the movement apparatus with a suitable control element, for example an electric stepper motor or a combination of electric motor and gear unit. This control element can then be activated by means of a suitable electronic controller. The electronic controller then actuates the control element automatically or according to the output signal of an electronic user interface connected to the controller, which can be formed for example by touch sensors, sliders or detachable magnetic toggles. The electronic controller can also be used for partially or fully automatic control of the gas valve unit.

LIST OF REFERENCE CHARACTERS

1 Twin-circuit gas burner
2 Twin-circuit gas valve
3 Gas inlet
4 Clamping plate
5 First magnetically active body
6 Second magnetically active body
8 Axis
11 First gas outlet
12 Second gas outlet
13 Permanent magnet
15 (15.1 to 15.3) First open/close valves
16 (16.1 to 16.6) Second open/close valves
17 (17.1 to 17.3) First throttle points
18 (18.1 to 18.6) Second throttle points
21 Inner burner
22 Outer burner
31 First gas outlet openings
32 Second gas outlet openings

The invention claimed is:

1. A gas valve unit for setting a gas volumetric flow to a twin-circuit gas burner of a gas appliance, said gas valve unit comprising:

a valve body having a gas inlet, a first gas outlet, and a second gas outlet, the first and second gas outlets for supplying the volumetric flow to the twin-circuit gas burner; and a control mechanism operated by a singular movement apparatus for adjusting the gas volumetric flow from the gas inlet to both of the first and second gas outlets, the control mechanism adjusting the gas volumetric flow from the gas inlet to at least one of the first and second gas outlets in a multiple-stage manner, said control mechanism having a zero position in which the gas volumetric flow to the first and second gas outlets is interrupted, and a switching position which is adjacent to the zero position and in which the gas volumetric flow to the second gas outlet is set to a maximum value, wherein the control mechanism for adjusting in the multiple-stage manner the gas volumetric flow from the gas inlet to the at least second gas outlet includes:

at least two second open/close valves;

at least two second throttle points; and a second throttle section, in which the second throttle points are disposed in series, and a connecting segment arranged between each set of two adjacent second throttle points and connecting one of the second open/close valves in an opened state to the gas inlet.

2. The gas valve unit of claim 1, constructed for setting the gas volumetric flow to each of the first and second gas outlets supplying the twin-circuit gas burner of the gas cooking appliance.

3. The gas valve unit of claim 1, wherein the control mechanism is configured to open the gas volumetric flow to the other one of the first and second gas outlets in the switching position.

4. The gas valve unit of claim 1, wherein the control mechanism is configured to set the gas volumetric flow to both of the first and second gas outlets in a multiple-stage manner and to set the gas volumetric flow to a maximum value in the switching position.

5. The gas valve unit of claim 1, wherein the control mechanism includes at least two first open/close valves and at least two first throttle points to set the gas volumetric flow supplied to the at least first gas outlet.

6. The gas valve unit of claim 5, wherein the control mechanism includes one of:

at least three first open/close valves and at least three first throttle points, and at least four second open/close valves and at least four second throttle points.

7. The gas valve unit of claim 5, wherein the control mechanism includes at least two magnetically active bodies to control the first and second open/close valves, with a first one of the magnetically active bodies being formed by a ferromagnetic body and a second one of the magnetically active bodies being formed by a permanent magnet.

8. The gas valve unit of claim 7, wherein the first one of the magnetically active bodies and the second one of the magnetically active bodies are coupled to one another in such a manner as to be movable synchronously relative to the first and second open/close valves.

9. The gas valve unit of claim 7, wherein at least one of the first open/close valves has a permanent magnet to allow control of the at least one of the first open/close valves as a function of a position of the first one of the magnetically active bodies.

10. The gas valve unit of claim 9, wherein the first one of the magnetically active bodies is configured to open the at least one of the first open/close valves in at least three switching positions of the control mechanism.

11. The gas valve unit of claim 9, wherein the first one of the magnetically active bodies opens in the switching position adjacent to the zero position the at least one of the first open/close valves, and the second one of the magnetically active bodies opens one of the second open/close valves.

12. The gas valve unit of claim 7, wherein in any switching position in which the second one of the magnetically active bodies opens at least one of the second open/close valves, the first one of the magnetically active bodies opens one of the first open/close valves.

13. The gas valve unit of claim 7, wherein in at least one switching position, in which the second one of the magnetically active bodies opens at least one of the first open/close valves, the first one of the magnetic bodies does not open any of the first and second open/close valves.

14. The gas valve unit of claim 7, wherein depending on a position of the second one of the magnetically active bodies, the second one of the magnetically active bodies either does not open any one of the first and second open/close valves, or opens just one of the first and second open/close valves, or opens just two of the first and second open/close valves.

15. The gas valve unit of claim 5, further comprising a first throttle section, in which the first throttle points are disposed in a row, and a connecting segment arranged between each set of two adjacent first throttle points and connecting one of the first open/close valves in an opened state to the gas inlet.

16. The gas valve unit of claim 15, wherein the throttle points of the first throttle section—when viewed in a gas flow direction in the first throttle section—have an increasing flow cross section.

17. The gas valve unit of claim 1, wherein the throttle points of the second throttle section—when viewed in a gas flow direction in the second throttle section—have an increasing flow cross section.

18. A gas cooking appliance comprising the gas valve unit and the twin-circuit gas burner of claim 1, wherein the twin-circuit gas burner includes an inner burner and an outer burner, and wherein the least one of the first and second gas outlets supplies the gas volumetric flow to the outer burner and the other one of the first and second gas outlets supplies the gas volumetric flow to the inner burner.

19. A gas valve unit for setting a gas volumetric flow to a twin-circuit gas burner of a gas appliance, said gas valve unit comprising:

a valve body having a gas inlet and two gas outlets, the two gas outlets for supplying the volumetric flow to the twin-circuit gas burner; and a control mechanism for adjusting the gas volumetric flow from the gas inlet to at least one of the two gas outlets in a multiple-stage manner, said control mechanism having a zero position in which the gas volumetric flow to the two gas outlets is interrupted, and a switching position which is adjacent to the zero wherein the control mechanism is configured in at least one of two ways, a first way in which the control mechanism includes at least two first open/close valves and at least two first throttle points to set the gas volumetric flow supplied to the one of the two gas outlets, wherein the at least two first open/close valves are arranged circumferentially about an axis, and a second way in which the control mechanism includes at least two second open/close valves and at least two second throttle points to set a gas volumetric flow supplied to the other one of the two gas outlets, wherein the at least two second open/close valves are arranged circumferentially about the axis.

20. A gas valve unit for setting a gas volumetric flow to a twin-circuit gas burner of a gas appliance, said gas valve unit comprising:

a valve body having a gas inlet and two gas outlets, the two gas outlets for supplying the volumetric flow to the twin-circuit gas burner; and a control mechanism for adjusting the gas volumetric flow from the gas inlet to at least one of the two gas outlets in a multiple-stage manner, said control mechanism having a zero position in which the gas volumetric flow to the two gas outlets is interrupted, and a switching position which is adjacent to the zero position and in which the gas volumetric flow is set to a maximum value, wherein the control mechanism includes at least two first open/close valves and at least two second open/close valves, wherein the control mechanism is configured in at least one of two ways, a first way in which the control mechanism includes the at least two first open/close valves and at least two first throttle points to set the gas volumetric flow supplied to the one of the two gas outlets, a second way in which the control mechanism includes the at least two second open/close valves and at least two second throttle points to set a gas volumetric flow supplied to the other one of the two gas outlets, wherein the control mechanism includes at least two magnetically active bodies to control the first and second open/close valves, with a first one of the magnetically active bodies being formed by a ferromagnetic body and a second one of the magnetically active bodies being formed by a permanent magnet, wherein the at least two first open/close valves and the at least two second open/close valves are arranged circumferentially about an axis, and wherein the at least two magnetically active bodies are movable circumferentially about the axis with respect to the at least two first open/close valves and the at least two second open/close valves to control the first and second open/close valves.

21. The gas valve unit of claim 20, wherein the first magnetically active body includes a C-shaped ferromagnetic body and the second magnetically active body is coupled to the first one of the magnetically active bodies.

22. A gas valve unit for setting a gas volumetric flow to a twin-circuit gas burner of a gas appliance, the gas valve unit comprising:

a valve body having a gas inlet, a first gas outlet, and a second gas outlet, the first gas outlet for supplying the volumetric flow to a first circuit of the twin-circuit gas burner, the second gas outlet for supplying the volumetric flow to a second circuit of the twin-circuit gas burner; and a single control mechanism for adjusting the gas volumetric flow from the gas inlet to each of the first gas outlet and the second gas outlet in a multiple-stage manner, the single control mechanism having a zero position in which the gas volumetric flow to each of the first gas outlet and the second gas outlet is interrupted, and a first switching position which is adjacent to the zero position and in which the gas volumetric flow to the second gas outlet is set to a maximum value, wherein the single control mechanism for adjusting in the multiple-stage manner the gas volumetric flow from the gas inlet to the second gas outlet includes:

at least two second open/close valves;

at least two second throttle points; and a second throttle section, in which the second throttle points are disposed in series, and a connecting segment arranged between each set of two adjacent second throttle points and connecting one of the second open/close valves in an opened state to the gas inlet.

23. The gas valve unit of claim 22, wherein the single control mechanism comprises at least one additional switching position which is adjacent to the first switching position and in which the gas volumetric flow to at least one of the first gas outlet and the second gas outlet is set to a value that is less than the maximum value but not entirely interrupted.

24. The gas valve unit of claim 22, constructed for setting the gas volumetric flow to each of the first and second gas outlets supplying the twin-circuit gas burner of the gas cooking appliance.

25. The gas valve unit of claim 22, wherein the single control mechanism is configured to open the gas volumetric flow to the other one of the first and second gas outlets in the switching position.

26. The gas valve unit of claim 22, wherein the single control mechanism is configured to set the gas volumetric flow to both of the first and second gas outlets in a multiple-stage manner and to set the gas volumetric flow to a maximum value in the switching position.

27. The gas valve unit of claim 22, wherein the single control mechanism includes at least two first open/close valves and at least two first throttle points to set the gas volumetric flow supplied to the at least first gas outlet.

28. The gas valve unit of claim 27, wherein the single control mechanism includes one of:

at least three first open/close valves and at least three first throttle points, and at least four second open/close valves and at least four second throttle points.

29. The gas valve unit of claim 27, wherein the single control mechanism includes at least two magnetically active bodies to control the first and second open/close valves, with a first one of the magnetically active bodies being formed by a ferromagnetic body and a second one of the magnetically active bodies being formed by a permanent magnet.

30. The gas valve unit of claim 29, wherein the first one of the magnetically active bodies and the second one of the magnetically active bodies are coupled to one another in such a manner as to be movable synchronously relative to the first and second open/close valves.

31. The gas valve unit of claim 29, wherein at least one of the first open/close valves has a permanent magnet to allow control of the at least one of the first open/close valves as a function of a position of the first one of the magnetically active bodies.

32. The gas valve unit of claim 31, wherein the first one of the magnetically active bodies is configured to open the at least one of the first open/close valves in at least three switching positions of the single control mechanism.

33. The gas valve unit of claim 31, wherein the first one of the magnetically active bodies opens in the switching position adjacent to the zero position the at least one of the first open/close valves, and the second one of the magnetically active bodies opens one of the second open/close valves.

34. The gas valve unit of claim 29, wherein in any switching position in which the second one of the magnetically active bodies opens at least one of the second open/close valves, the first one of the magnetically active bodies opens one of the first open/close valves.

35. The gas valve unit of claim 29, wherein in at least one switching position, in which the second one of the magnetically active bodies opens at least one of the first open/close valves, the first one of the magnetic bodies does not open any of the first and second open/close valves.

36. The gas valve unit of claim 29, wherein depending on a position of the second one of the magnetically active bodies, the second one of the magnetically active bodies either does not open any one of the first and second open/close valves, or opens just one of the first and second open/close valves, or opens just two of the first and second open/close valves.

37. The gas valve unit of claim 29, wherein the at least two first open/close valves and the at least two second open/close valves are arranged circumferentially about an axis, and wherein the at least two magnetically active bodies are movable circumferentially about the axis with respect to the at least two first open/close valves and the at least two second open/close valves to control the first and second open/close valves.

38. The gas valve unit of claim 27, further comprising a first throttle section, in which the first throttle points are disposed in a row, and a connecting segment arranged between each set of two adjacent first throttle points and connecting one of the first open/close valves in an opened state to the gas inlet.

39. The gas valve unit of claim 38, wherein the throttle points of the first throttle section—when viewed in a gas flow direction in the first throttle section—have an increasing flow cross section.

40. The gas valve unit of claim 27, wherein the at least two first open/close valves and the at least two second open/close valves are arranged circumferentially about an axis.

41. The gas valve unit of claim 22, wherein the throttle points of the second throttle section—when viewed in a gas flow direction in the second throttle section—have an increasing flow cross section.

42. A gas cooking appliance comprising the gas valve unit and the twin-circuit gas burner of claim 22, wherein the twin-circuit gas burner includes an inner burner and an outer burner, and wherein the least one of the first and second gas outlets supplies the gas volumetric flow to the outer burner and the other one of the first and second gas outlets supplies the gas volumetric flow to the inner burner.

43. The gas valve unit of claim 22, wherein the at least two second open/close valves are arranged circumferentially about an axis.

44. A gas valve unit for setting a gas volumetric flow to a twin-circuit gas burner of a gas appliance, said gas valve unit comprising:

a valve body having a gas inlet, a first gas outlet, and a second gas outlet, the first and second gas outlets for supplying the volumetric flow to the twin-circuit gas burner; and a control mechanism for adjusting the gas volumetric flow from the gas inlet to both of the first and second gas outlets, the control mechanism adjusting the gas volumetric flow from the gas inlet to at least one of the first and second gas outlets in a multiple-stage manner, said control mechanism having a zero position in which the gas volumetric flow to the first and second gas outlets is interrupted, and a switching position which is adjacent to the zero position and in which the gas volumetric flow to the second gas outlet is set to a maximum value, wherein the control mechanism for adjusting in the multiple-stage manner the gas volumetric flow from the gas inlet to the at least second gas outlet includes:

at least two second open/close valves;

at least two second throttle points; and a second throttle section, in which the second throttle points are disposed in series, and a connecting segment arranged between each set of two adjacent second throttle points and connecting one of the second open/close valves in an opened state to the gas inlet, wherein the at least two second open/close valves are arranged circumferentially about an axis.

* * * * *